US006542708B1

(12) United States Patent
Budny

(10) Patent No.: US 6,542,708 B1
(45) Date of Patent: Apr. 1, 2003

(54) METHOD OF REPLENISHING DEVELOPER WITH ZINC STEARATE

(75) Inventor: Thomas J. Budny, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/964,397

(22) Filed: Sep. 28, 2001

(51) Int. Cl.[7] ..... G03G 15/08
(52) U.S. Cl. ..... 399/259
(58) Field of Search ..... 399/252, 258, 399/259; 430/45, 106.1, 107.1, 108.1, 137.1, 137.13

(56) References Cited

U.S. PATENT DOCUMENTS

| | | | | |
|---|---|---|---|---|
| 3,590,000 A | | 6/1971 | Palermiti et al. | |
| 3,800,588 A | | 4/1974 | Larson et al. | |
| 3,847,604 A | | 11/1974 | Hagenbach et al. | |
| 4,265,990 A | | 5/1981 | Stolka et al. | |
| 4,298,672 A | | 11/1981 | Lu | |
| 4,331,756 A | | 5/1982 | Mayer et al. | |
| 4,338,390 A | | 7/1982 | Lu | |
| 4,614,165 A | | 9/1986 | Folkins et al. | |
| 4,935,326 A | | 6/1990 | Creatura et al. | |
| 4,937,166 A | | 6/1990 | Creatura et al. | |
| 5,071,726 A | | 12/1991 | Maniar | |
| 5,171,653 A | | 12/1992 | Jugle et al. | |
| 5,230,980 A | * | 7/1993 | Maniar | 430/137.13 |
| 5,424,160 A | | 6/1995 | Smith et al. | |
| 5,536,608 A | * | 7/1996 | O'Brien et al. | 430/45 |
| 5,557,393 A | | 9/1996 | Goodman et al. | |
| 5,561,013 A | * | 10/1996 | O'Brien et al. | 430/45 |
| 5,569,572 A | | 10/1996 | Laing et al. | |
| 5,595,851 A | | 1/1997 | Creatura et al. | |
| 5,795,692 A | | 8/1998 | Lewis | |
| 5,900,344 A | | 5/1999 | Silence et al. | |
| 5,968,703 A | | 10/1999 | Maniar et al. | |
| 6,004,717 A | | 12/1999 | Creatura et al. | |
| 6,068,959 A | | 5/2000 | Nakamura et al. | |
| 6,096,466 A | | 8/2000 | Imai et al. | |
| 6,194,117 B1 | | 2/2001 | Smith et al. | |
| 6,248,496 B1 | | 6/2001 | Galloway et al. | |

FOREIGN PATENT DOCUMENTS

| | | |
|---|---|---|
| GB | 1442835 | 7/1976 |

* cited by examiner

*Primary Examiner*—Sandra Brase
(74) *Attorney, Agent, or Firm*—Oliff & Berridge, PLC; Eugene O. Palazzo

(57) ABSTRACT

A method of replenishing developer, wherein the replenisher contains carrier particles coated with zinc stearate.

15 Claims, 2 Drawing Sheets

METHOD OF REPLENISHING DEVELOPER WITH ZINC STEARATE

BACKGROUND OF THE INVENTION

1. Field of Invention

This invention relates to a replenisher for a xerographic device and a method of replenishing a xerographic device.

2. Description of Related Art

The electrostatographic process, and particularly the xerographic process, is well known. This process involves the formation of an electrostatic latent image on a photoreceptor, followed by development of the image with a developer, and subsequent transfer of the image to a suitable substrate.

Numerous different types of xerographic imaging processes are known wherein, for example, insulative developer particles or conductive developer particles are selected depending on the development systems used. Moreover, of importance with respect to the aforementioned developer compositions is the appropriate triboelectric charging values associated therewith, as it is these values that enable continued formation of developed images of high quality and excellent resolution. In two component developer compositions, carrier particles are used in charging the toner particles.

Carrier particles in part consist of a roughly spherical core, often referred to as the "carrier core," which may be made from a variety of materials. The core is optionally coated with a resin. This resin may be made from a polymer or copolymer. The resin may optionally have conductive material or charge enhancing additives incorporated into it to provide the carrier particles with more desirable and consistent triboelectric properties.

A problem often encountered with xerographic devices resides in fluctuating triboelectric charging characteristics, particularly over extended use. For example, a developer may start with a certain triboelectric value, and after extended use, the developer may have a significantly lower triboelectric value. This variation in the triboelectric value may result in poor copy quality.

It is known in the art to add additional toner and/or carrier materials to the housing of a xerographic device in order to replenish the materials depleted by the copying (image formation) process of the electrophotographic device. See, for example, U.S. Pat. No. 4,614,165, incorporated herein by reference in its entirety.

In U.S. Pat. No. 4,331,756 to Mayer et al., an electrophotographic developer composition containing a mixture of carrier, toner and zinc stearate as a lubricating additive is described. Mayer describes that it is not possible to completely coat the carrier with zinc stearate since the abrasive action of the constantly moving developer continuously removes the zinc stearate. The zinc stearate is added directly to the developer as a separate component. The zinc stearate is also used as an additive to the toner.

In U.S. Pat. No. 5,171,653 to Jugle et al., a developer composition is described which consists essentially of a toner consisting essentially of a resin, a colorant, a charge control agent, and colloidal silica external additive particles and a carrier consisting essentially of a core, an optional coating on the core, and an external additive selected from the group consisting of metal salts of fatty acids, linear polymeric alcohols comprising a fully saturated hydrocarbon backbone with at least about 80 percent of the polymeric chains terminated at one chain end with a hydroxyl group, polyethylene waxes with a molecular weight of from about 300 to about 2,000, polypropylene waxes with a molecular weight of from about 300 to about 3,000, and mixtures thereof. The metal salt of fatty acids may be zinc stearate. A method of adding a replenisher with a higher triboelectric value than the developer to which the replenisher is added is not disclosed, nor is a method of adding a replenisher containing a zinc stearate coated carrier with a higher triboelectric value than the developer to which the replenisher is added disclosed.

The addition of additional fresh toner and/or carrier will enable the user to maintain preferred triboelectric values in the electrophotographic device. However, this is an expensive method to maintain the triboelectric value since the xerographic device will use extra toner and/or carrier. Further, the addition of fresh toner and/or carrier results in increased amounts of waste in the sump of the xerographic device.

What is desired is a better method of maintaining the triboelectric value of developer by adding an improved replenisher that requires less of the replenisher.

What is desired is a replenisher that maintains the triboelectric properties of a xerographic device over an extended period of use.

SUMMARY OF THE INVENTION

It is an object of the present invention to provide a replenisher for a xerographic device that maintains the triboelectric properties over an extended period of use of the xerographic device.

It is a further object of the present invention to provide a replenisher that produces less waste.

It is a still further object of the present invention to provide a method of replenishing the developer that is economical.

These and other objects of the present invention are achieved by providing a replenisher comprising carrier particles coated with zinc stearate. The zinc stearate coated carrier particles may have a higher triboelectric value than the carrier originally present in the developer.

DETAILED DESCRIPTION OF PREFERRED EMBODIMENTS

Figure 1:
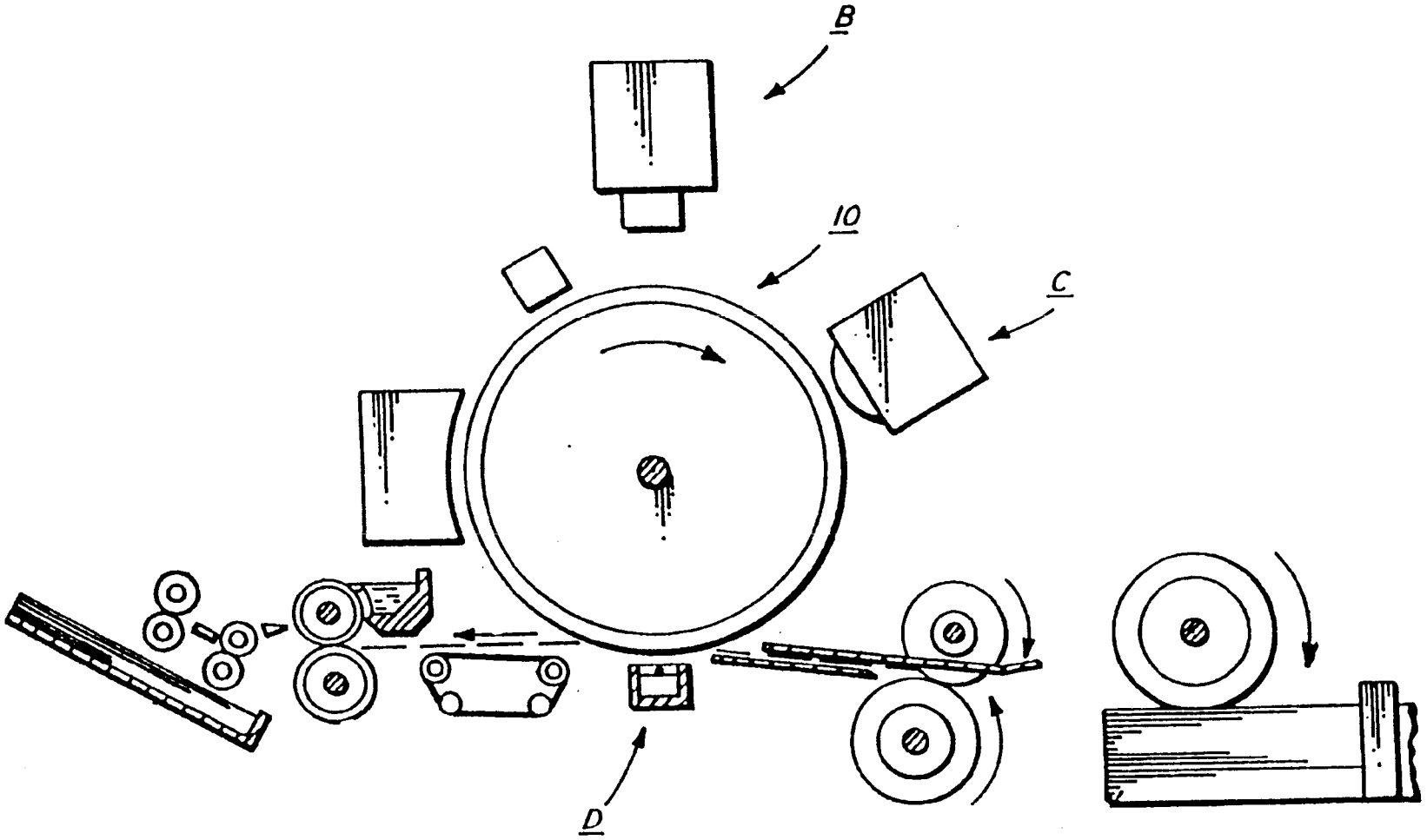
FIG. 1 is an example of an imaging device that may be used in the present invention.

Generally, the process of electrophotographic printing includes charging a photoconductive member to a substantially uniform potential to sensitize the surface thereof. The charged portion of the photoconductive surface is exposed to a light image from, for example, a scanning laser beam, an LED source, etc., or an original document being reproduced. This records an electrostatic latent image on the photoconductive surface of the photoreceptor. After the electrostatic latent image is recorded on the photoconductive surface, the latent image is developed.

Electrophotographic printing members, i.e., photoreceptors, in the form of plates, drums or flexible belts are well known in the art. Typically, a substrate is provided having an electrically conductive surface. At least one charge generation layer or photoconductive layer is then applied to the electrically conductive surface. A charge-blocking layer may be applied to the electrically conductive surface prior to the application of the charge-generating layer or photoconductive layer. If desired, an adhesive layer may be utilized between the charge blocking layer and the photoconductive layer. For multilayered photoreceptors, a charge generation layer or charge generation section is usually applied onto the blocking layer or optional adhesive layer and a charge transport layer (hole transport layer) is formed on the charge generation section. However, if desired, the charge generation section or layer may be applied to the charge transport layer. Optionally, an overcoating layer may be applied to increase abrasion resistance. Optionally, an anti-curl backing layer may be applied to improve abrasion resistance and/or shape.

Numerous different types of xerographic imaging processes are known wherein, for example, insulative developer particles or conductive developer particles are selected depending on the development systems used. Moreover, of importance with respect to the aforementioned developer compositions is the appropriate triboelectric charging values associated therewith, as it is these values that enable continued formation of developed images of high quality and excellent resolution. In two component developer compositions, carrier particles are used in charging the toner particles.

A supply of developer material is formed in a chamber within a housing of the image forming device. The developer material may be formed in the chamber by mixing the toner and carrier with mechanical means such as an auger, or pre-formed developer may be added to the chamber. During the development process, the developer is transported from the chamber to the photoreceptor surface where the toner particles are removed from the developer material and attach to the photoreceptor surface for transfer to a substrate.

As successive electrostatic latent images are developed, the toner particles within the developer material are depleted and/or the triboelectric properties of the developer may fluctuate. A dispenser stores a supply of replenisher. The replenisher may contain developer, toner, and/or carrier. The replenisher may contain developer with a different concentration of toner and carrier than the developer originally present in the chamber. Also, multiple dispensers may be present containing replenisher of only toner or only carrier particles. The dispensers are in communication with the chamber.

As the concentration of toner particles in the developer material is decreased, replenisher is furnished to the developer material in the chamber from the dispenser. The augers in the chamber mix the replenisher with the remaining developer material so that the resultant developer material therein is substantially uniform with the concentration of toner particles and the triboelectric value of the resultant developer is adjusted. In this manner, a substantially constant amount of toner particles are maintained in the chamber and the triboelectric value of the developer is maintained.

In order to provide additional toner into the housing containing the chamber and also to address the aging of the toner and carrier of the developer within the housing, so-called trickle-through may be used. See U.S. Pat. No. 4,614,165, as well as U.S. Pat. No. 5,557,393 which are incorporated herein by reference in their entirety. In a trickle-through system, the dispenser dispenses a combination of toner and carrier particles, i.e., a replenisher. Replenisher typically contains greater amounts of toner to carrier than in the initially charged developer. While additional replenisher is being added to the developer housing, a small amount of developer is continuously being removed from the developer housing by means of a drop tube or other mechanism, the rate of addition being approximately equal to the rate of toner usage and developer removal. Such a trickle-through system is disclosed in both U.S. Pat. Nos. 4,614,165 and 5,557,393.

The replenisher of the present invention incorporates a carrier coated with zinc stearate into the developer. The replenisher of the present invention has a higher triboelectric value than the developer in the chamber. In a preferred embodiment, the replenisher is higher in triboelectric value than the original developer material prior to extended use.

The zinc stearate coated carrier may be the only material in the replenisher, or, the zinc stearate coated carrier may be used in conjunction with toner particles or other material. The replenisher may also contain the zinc stearate coated carrier and an additional amount of the original developer material already present in the chamber. The replenisher may also contain the zinc stearate coated carrier and an amount of the same toner used in the original developer material already present in the chamber. In a preferred embodiment, the replenisher contains a zinc stearate coated carrier which is the same carrier as originally present in the developer material (without the zinc stearate coating).

Replenisher materials must operate in a consistent, predictable manner which result in a stable charge level and a stable conductivity level of the developer throughout operation of the imaging device. The most significant replenisher material parameter is the ratio of toner to carrier in the replenisher (i.e., the replenisher ratio) to provide the tribo and conductivity stability to the developer. In the present invention, the ratio may not be applicable since the replenisher may only contain zinc stearate coated carrier.

In the present invention, two-component developer materials are used in the first step of the development process. A typical two-component developer comprises magnetic carrier granules having toner particles adhering triboelectrically thereto. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

Suitable and preferred materials for use as carriers and toners in preparing the replenisher of the present invention will now be discussed.

The carrier particles may include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the entire disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby incorporated herein by reference. An iron gritted carrier is particularly preferred.

Carrier cores having a diameter in a range of, for example, about 5 micrometers to about 200 micrometers may be used. Preferably, the carriers are, for example, about 40 micrometers to about 120 micrometers. Most preferably, the carriers are, for example, about 80 micrometers.

The carrier may be coated with any suitable known polymer such as polyesters, polyester-urethanes, polyurethanes, cross-linked polyurethanes, polyalkylmethacrylates, fluorinated polymers, polystyrenes, styrene-acrylate copolymers, mixtures thereof, and the like materials, including polymethylmethacrylates, polyvinylidene fluorides, and the like materials. The polymeric coating is optional in the replenisher of the present invention. However, in a preferred embodiment, the carrier is coated with the polymeric material prior to the coating of the zinc stearate.

The polymeric carrier coating selected may coat the carrier in amounts of about 0.1 to about 3.0 weight percent, and more preferably in amounts of about 0.5 to about 1.5 weight percent, based on the weight of the carrier particles. Polymethylmethacrylates are particularly preferred. The polymeric carrier coating can further comprise additional known performance additives, such as conductive and non-conductive additives, including but not limited to colored and colorless pigments, organic and inorganic fillers, dyes, such as dye compounds, and mixtures thereof, and more specifically, such as carbon black, magnetites, copper iodides, fillers including glass, minerals, and the like materials.

Suitable resins for the toner for use with the carrier particles of the present invention include, for example, styrene-butadienes, styrene acrylates, styrene methacrylates, polyesters, and the like polymers, and mixtures thereof and other known resins. The toner can be selected in amounts, for example, from about 0.1 to about 10 weight percent based on the weight of the carrier particles.

The toner optionally used in the replenisher of the present invention may be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion. Toner compositions may be prepared by admixing and heating resin particles such as styrene butadiene copolymers, colorant particles such as magnetite, carbon black, or mixtures thereof, and cyan, yellow, magenta, green, red, blue, red, orange, violet or brown or mixtures thereof, and preferably from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel and then classified.

The toner is preferably made by first mixing the binder, preferably comprised of both a linear resin and a cross-linked resin, and the colorant together in a mixing device, preferably an extruder, and then extruding the mixture. In a most preferred embodiment of the present invention, the toner binder resin comprises a melt extrusion of (a) linear propoxylated bisphenol A fumarate resin and (b) this resin cross-linked by reactive extrusion of this linear resin, with the resulting extrudate comprising a resin with an overall gel content of from about 2 to about 9 weight percent. See, for example, U.S. Pat. No. 6,248,496, incorporated by reference herein in its entirety. Linear propoxylated bisphenol A fumarate resin is available under the tradename SPARII from Resana S/A Industrias Quimicas, Sao Paulo Brazil, or as Neoxyl P2294 or P2297 from DSM Polymer, Geleen, The Netherlands.

The toner is then classified to form a toner with the desired volume median particle size and percent fines as discussed above. Care should also be taken in the method in order to limit the coarse particles, grits and giant particles. Subsequent toner blending of the remaining external additives is preferably accomplished using a mixer or blender, for example a Henschel mixer, followed by screening to obtain the final toner product.

The toner product may be optionally blended with external surface additives in a manner to enable even distribution and firm attachment of the surface additives, for example by using a high intensity blender. The external surface additives assist the toner to achieve the appropriate level and stability of toner flow and triboelectric properties.

Examples of these surface additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight of the toner. Several of the aforementioned additives are illustrated in U.S. Pat. Nos. 3,590,000 and 3,800,588, the disclosures of which are totally incorporated herein by reference.

The resulting toner particles can then be used in the replenisher of the present invention or the developer material used in conjunction with the replenisher of the present invention. Any suitable developer material may be used with the replenisher of the present invention as long as the replenisher has a higher triboelectric value than the developer material.

Illustrative examples of resins suitable for toner and developer compositions of the present invention include linear or branched styrene acrylates, styrene methacrylates, styrene butadienes, vinyl resins, including linear or branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like.

Colorant for the toner includes pigments, dyes, mixtures thereof, mixtures of pigments, mixtures of dyes, and the like. Numerous well known suitable colorants, such as pigments or dyes, can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The toner composition used in conjunction with the coated or uncoated carriers of the present invention can be prepared by a number of known methods as indicated herein including extrusion melt blending the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The replenisher of the present invention may be used with two-component xerographic developers. Two-component xerographic developers can be made either insulating or conducting depending upon whether the carrier particles are conductive, reference for example, the Xerox Corporation Model 1090® series which employs partially coated carriers having conductivities of about $10^{-10}$ (ohm-cm)$^{-1}$ and completely coated carriers of the Xerox Corporation Model 5090® series with conductivities of less than about $10^{-14}$ (ohm-cm)$^{-1}$. Developer conductivity increases the rate of solid-area development (SAD) and thus is a means of improving "fill" of extended areas in magnetic brush development. In hybrid scavengeless development (HSD) and hybrid jumping development (HJD), a magnetic brush deposits toner on a donor roller, and this donor subsequently develops the image, reference for example the Xerox Corporation DOCUCENTRE® 265 development system. Hybrid scavengeless development is a particularly preferred method of development.

Hybrid scavengeless development (HSD) technology develops toner via a conventional magnetic brush onto the surface of a donor roll. A plurality of electrode wires is closely spaced from the toned donor roll in the development zone. An AC voltage is applied to the wires to generate a toner cloud in the development zone. This donor roll generally consists of a conductive core covered with a thin, for example 50–200 $\mu$m, partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles. Typical AC voltages of the wires relative to the donor are 700–900 Vpp at frequencies of 5–15 kHz. These AC signals are often square waves, rather than pure sinusoidal waves. Toner from the cloud is then developed onto the nearby photoreceptor by fields created by a latent image.

It is important that the donor roll be completely reloaded with toner in just one revolution. The inability to complete reloading of the donor roll in one revolution will result in a print quality defect called reload. This defect is seen on prints as solid areas that become lighter with successive revolutions of the donor roll, or alternately if the structure of an image from one revolution of the donor roll is visible in the image printed by the donor roll on its next revolution, a phenomenon known as ghosting in the art related to single component xerographic development. Highly conductive developers aid in the reduction of this defect. The more conductive developers allow for the maximum transfer of toner from the magnetic brush to the donor roll. Therefore, it is desirable to select developer materials which when combined, are conductive enough to reload the donor roll in a single revolution.

The conductivity of the developer is primarily driven by the carrier conductivity. To achieve the most conductive carrier possible, electrically conductive carrier cores, for example atomized steel cores, with partial coatings of electrically insulating polymers to allow a level of exposed carrier core, are used. An alternative technology of using conductive polymers to coat the carrier core is also feasible. Additionally, irregularly shaped carrier cores provide valleys into which the polymer coating may flow, leaving exposed asperities for more conductive developers. Irregularly shaped carrier cores also function to allow toner particles to contact the surface of the carrier core in the valleys to provide charge to the toner while not interfering with the contact between the uncoated carrier asperities which provides the overall developer conductivity. The addition of zinc stearate to the toner additive package also assists in the lubrication of the carrier and toner, increasing the number of contacts between carrier and toner particles.

Preferably, the conductivity of the developer ranges from, for example, between $10^{-11}$ and $10^{-14}$ (ohm-cm)$^{-1}$, at a toner concentration of between 3.5 and 5.5 percent by weight as measured, for example, across a 0.1 inch magnetic brush at an applied potential of 30 volts. At a toner concentration of between 0 and 0.5 percent, that is bare carrier or carrier that has only a small amount of residual toner on the surface, the carrier has a conductivity of between $10^{-6}$ and $10^{-11}$ (ohm-cm)$^{-1}$ as measured under the same conditions.

It is desired that freshly added toner rapidly gains charge to the same level of the incumbent toner in the developer. If this is not the case, two distinct situations may occur. When freshly added toner fails to rapidly charge to the level of the toner already in the developer, a situation known as "slow admix" occurs. Distributions can be bimodal in nature, meaning that two distinct charge levels exist side-by-side in the development subsystem. In extreme cases, freshly added toner that has no net charge may be available for development onto the photoreceptor. Conversely, when freshly added toner charges to a level higher than that of toner already in the developer, a phenomenon known as "charge-thru" occurs. Also characterized by a bimodal distribution, in this case the low charge or opposite polarity toner is the incumbent toner (or toner that is present in the developer prior to the addition of fresh toner). The failure modes for both slow admix and charge-thru are the same as those for low charge toner state above, most notably background and dirt in the machine, wire history, interactivity, and poor text quality.

Thus, a replenisher which will provide charge stability is desirable. This will enable an average charge level that avoids failure modes of both too high and too low charge. This will preserve development of solids, halftones, fine lines and text, as well as prevention of background and image contamination. The replenisher must be such that the developer and toner charge level and distribution are maintained over the full range of customer run modes.

It is the case that the developer becomes more insulative over time due to impaction of toner onto the carrier coating and transfer of toner external additives to the carrier. It is therefore necessary to replenish the developer with fresh materials which will dampen, preferably eliminate, this decay in the developer conductivity. A system which has trickle as discussed above allows for the maintenance of developer conductivity levels.

It is desirable to select a replenisher which will dampen, preferably eliminate, the decay of developer conductivity over time. The replenisher will then allow the developer materials to remain conductive enough to reload the donor roll in a single revolution.

In operation, toner will be used in developing latent images upon the surface of the imaging member (e.g., photoreceptor), and may need to be replenished in the developer chamber of the housing. Thus, during operation in replenishment mode, additional toner may be added into the developer chamber in the housing from dispensers containing replenisher in order to maintain toner within the housing. The replenisher is usually comprised of both toner particles and carrier particles. It is possible to have replenisher containing only toner and a replenisher containing only carriers both replenishing the chamber. The replenisher ratio (toner:carrier) in the replenisher is very significant since the replenishment rate (i.e., the rate at which the replenisher is added into the housing) will necessarily add the amount of carrier set by the ratio along with the amount of toner being added. Thus, the replenisher ratio must be appropriately determined so that the amount of carrier added at the replenishment rate is appropriate to maintain continued proper operation of the imaging device. Preferably, the ratio of toner to carrier in the replenisher is about 2 parts to about 6 parts toner to about 1 part carrier.

The addition of a zinc stearate coating to the carrier also assists in the lubrication of the carrier and toner, therefore increasing the number of contacts between carrier and toner particles. Over time, however, the toner and external additive become impacted in the carrier coating, resulting in a decrease in developer conductivity. Therefore, it is desirable to select a replenisher which will dampen, and preferably eliminate, the decay of developer conductivity over time. This replenisher will then allow the developer materials to remain conductive enough to reload the donor roll in a single revolution. A problem often encountered with xerographic devices resides in fluctuating triboelectric charging characteristics, particularly over extended use. Prior art developers may start with a triboelectric value of 65, and after extended use, the prior art developer may then have a triboelectric value of 40. This reduction in the triboelectric value will result in poor copy quality. The replenisher of the present invention assists in maintaining the triboelectric value during extended use.

Zinc stearate also provides developer conductivity and tribo enhancement, both due to its lubricating nature. In addition, zinc stearate enables higher toner charge and charge stability by increasing the number of contacts between toner and carrier particles. The zinc stearate may have an average particle diameter of about 1 micron to about 30 microns. Preferably, the zinc stearate has an average particle diameter of about 5 microns to about 10 microns. Most preferred is a commercially available zinc stearate known as Zinc Stearate L, obtained from Ferro Corporation, which has an average particle diameter of about 9 microns, as measured in a Coulter counter.

The zinc stearate may be coated upon the carrier by any low intensity mixing device. The zinc stearate is coated on the carrier particles in an amount of about 0.01% to about 0.1% by weight of the carrier particles. Preferably, the zinc stearate is coated upon the carrier particles in an amount of about 0.05% by weight of the carrier particles. The zinc stearate coating may be coated on bare carriers or carriers previously coated with other polymers, resins, additives, etc.

For further enhancing the positive charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like and other similar known charge enhancing additives. Also, negative charge enhancing additives may also be selected, such as aluminum complexes, like BONTRON E-88®, and the like. These additives may be incorporated into the toner in an amount of from about 0.1 percent by weight to about 20 percent by weight, and preferably from 1 to about 3 percent by weight.

The carrier core and coating, as well as the toner additives discussed above, are all chosen to enable high developer charge and charge stability. The processing conditions of the carrier, as well as the levels of toner additives selected, can be manipulated to affect the developer charging level. The replenisher may contain carrier particles with or without a polymeric coating.

In a preferred embodiment, the carrier core is first coated with a polymethyl methacrylate (PMMA) polymer. After the PMMA coating, the zinc stearate is coated upon the PMMA coated carrier. The PMMA has a weight average molecular weight of 300,000 to 350,000 and is commercially available from Soken. The PMMA is an electropositive polymer in that the polymer that will generally impart a negative charge on the toner with which it is contacted.

The PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like.

The carrier particles may be prepared by mixing the carrier core with from, for example, between about 0.1 to about 3.0 percent by weight, more preferably between about 0.5 percent and about 1.5 percent by weight, based on the weight of the coated carrier particles, of polymer until adherence thereof to the carrier core by mechanical impaction and/or electrostatic attraction.

The polymer is most preferably applied in dry powder form and has an average particle size of less than 1 micrometer, preferably less than 0.5 micrometers. Various effective suitable means can be used to apply the polymer to the surface of the carrier core particles. Examples of typical means for this purpose include combining the carrier core material and the polymer by cascade roll mixing, or tumbling, milling, shaking, electrostatic powder cloud spraying, fluidized bed, electrostatic disc processing, and with an electrostatic curtain.

The mixture of carrier core particles and polymer is then heated to fix the polymer to the core surface. For example, the mixture is heated to a temperature of from about 330° F. to about 480° F., for a period of time of from, for example, about 10 minutes to about 60 minutes, enabling the polymer to melt and fuse to the carrier core particles. The coated carrier particles are then cooled and thereafter classified to a desired particle size. Thereafter, the PMMA coated carrier is coated with zinc stearate.

In the replenisher of the present invention, the carrier particles may optionally be mixed with toner particles in various suitable combinations. However, best results are obtained when about 2 parts to about 6 parts by weight of toner particles are mixed with about 1 part by weight of the carrier particles.

In a preferred embodiment, the replenisher is higher in triboelectic value than the developer material originally present in the chamber before extended use of the developer material. Thus, a smaller amount of the replenisher of the present invention may be added to replenish the developer material than by adding more of the original developer material. This results in a significant reduction in the amount of waste material requiring disposal than in prior art replenishing systems using more of the original developer as replenisher.

In a another preferred embodiment, the carrier particle coated with zinc stearate used in the replenisher is the same as the carrier particle used in the developer. Thus, the carrier particle used in the replenisher may be the same as the original carrier particle used in the developer, although the replenisher carrier particle is additionally coated with zinc stearate.

In a another preferred embodiment, the carrier core of the zinc stearate coated carrier particle is the same as the carrier core of the carrier particle used in the developer, while other additives and coatings may be present on both of the carrier core of the carrier particle used in the developer and the carrier core of the zinc stearate coated carrier particle.

FIG. 1 illustrates an imaging device that may be used in conjunction with the present invention. In FIG. 1, 10 is an imaging number, B represents means for forming an electrostatic latent image on the imaging member, C represents means for developing the electrostatic latent image to form a toner image and D represents means for transferring the toner image to a substrate.

Figure 2:
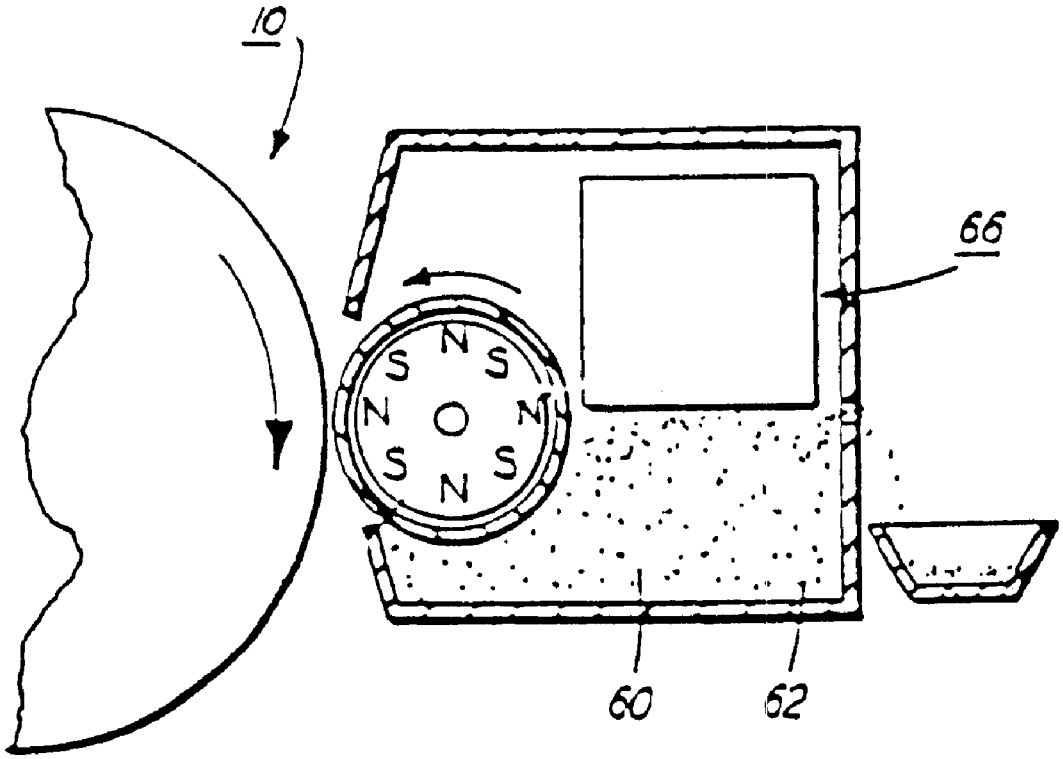
FIG. 2 is an example of a housing for feeding developer in the example imaging device of FIG. 1

FIG. 2 is an example of a design of a chamber for feeding developer to an imaging member. In FIG. 2, 62 represents a chamber containing developer 60 therein, and 66 represents a dispenser for dispensing replenisher into the chamber.

EXAMPLE I

In a most preferred embodiment of the present invention, an 80 micron iron gritted carrier coated with PMMA is utilized. The carrier is mixed with a zinc stearate powder having an average particle diameter of about 5 to about 10 microns in a MUNSON® mixer. The carrier is coated with about 0.05% of the zinc stearate by weight of the carrier. This carrier, coated with the PMMA and the zinc stearate, is used as a replenisher in a xerographic device.

The carrier, coated with zinc stearate and PMMA, is stored in the dispenser of the xerographic device. As required to maintain the desired triboelectric values, the coated carrier is dispensed into the developer.

The replenisher of the present invention finds particular utility in a variety of xerographic copiers and printers, such as high speed xerographic color copiers, printers, digital copiers and more specifically, wherein color copies with excellent and substantially no background deposits are desirable in copiers, printers, digital copiers, and the combination of xerographic copiers and digital systems.

What is claimed is:

1. A method of replenishing a developer comprising:

dispensing a replenisher comprised of first carrier particles coated with zinc stearate into a chamber comprising the developer, wherein the developer comprises toner and second carrier particles, wherein the first carrier particles coated with zinc stearate have a higher triboelectric value than the developer, and also have a higher triboelectric value than the developer prior to initial use of the developer.

2. The method of claim 1, wherein an amount of the coating of zinc stearate on the first carrier particles is about 0.01% to about 0.1% by weight of the first carrier particles.

3. The method of claim 1, wherein an amount of the coating of zinc stearate on the first carrier particles is about 0.05% by weight of the first carrier particles.

4. The method of claim 1, wherein the first carrier particles coated with zinc stearate are also coated with a polymer and/or copolymer.

5. The method of claim 4, wherein the polymer and/or copolymer is polymethylmethacrylate.

6. The method of claim 1, wherein the first carrier particles have a diameter of abut 80 microns.

7. The method of claim 1, wherein the zinc stearate has an average particle diameter of about 5 to about 10 microns.

8. The method of claim 1, wherein the first carrier particles and the second carrier particles are the same.

9. The method of claim 1, wherein the replenisher consists of first carrier particles comprised of a carrier core with a coating of zinc stearate, and wherein toner is added to the chamber by a second dispenser.

10. The method of claim 1, wherein the replenisher additionally contains toner, and a ratio of toner to the first carrier particles coated with zinc stearate is about 2 to about 6 parts toner to about 1 part of the first carrier particles.

11. An imaging device, comprising:

a chamber containing developer, a dispenser for dispensing a replenisher comprised of first carrier particles coated with zinc stearate into the chamber containing developer, wherein the developer comprises toner and second carrier particles, and wherein the replenisher has a higher triboelectric value than the developer, and also has a higher triboelectric value than the developer prior to initial use of the developer.

12. The imaging device of claim 11, wherein the replenisher has a higher triboelectric value than the developer prior to initial use of the developer.

13. The imaging device claim 11, wherein an amount of the coating of zinc stearate on the first carrier particles is about 0.01% to about 0.1% by weight of the first carrier particles.

14. The imaging device of claim 11, wherein the replenisher additionally contains toner, and a ratio of toner to the first carrier particles coated with zinc stearate is about 2 to about 6 parts toner to about 1 part of the first carrier particles.

15. The imaging device of claim 11, further comprising an imaging member, means for forming an electrostatic latent image on the imaging member, means for developing the electrostatic latent image to form a toner image using the toner from the developer in the container, and means for transferring the toner image to a substrate.

* * * * *